US005277303A

United States Patent [19]

Goyet et al.

[11] Patent Number: 5,277,303

[45] Date of Patent: Jan. 11, 1994

[54] TWO BOTTLE PACKAGING ALLOWING SEPARATE STORAGE AND MIXING FOR USE OF TWO PRODUCTS, PARTICULARLY LIQUIDS

[75] Inventors: Daniel Goyet, Saint Witz; Fabrice Boe-Dreyfus, Levallois, both of France

[73] Assignee: L'Oreal, Paris, France

[21] Appl. No.: 929,202

[22] Filed: Aug. 14, 1992

[30] Foreign Application Priority Data

Aug. 16, 1991 [FR] France ..... 91 10378

[51] Int. Cl.[5] ..... B65D 25/08

[52] U.S. Cl. ..... 206/221; 206/219; 215/DIG. 8

[58] Field of Search ..... 206/219, 221, 568; 215, DIG. 8; 206/568

[56] References Cited

U.S. PATENT DOCUMENTS 1,731,847 10/1929 Eckart, Jr. ..... 206/221
3,410,444 11/1968 Morane ..... 206/221
4,203,517 5/1980 Hildebrandt et al. ..... 206/221
4,693,366 9/1987 Goncalves ..... 215/DIG. 8
5,000,314 3/1991 Fuller et al. ..... 206/219

*Primary Examiner*—David T. Fidei
*Attorney, Agent, or Firm*—Cushman, Darby & Cushman

[57] ABSTRACT

The packaging comprises a first bottle (1) open at the base to form a skirt (3), and fitted at the top with a distributor fitting (7); an intermediate component (8) affixed to the base of the first bottle with a central duct (9) admitting a separable plug (10); a second bottle (2) with a neck (24) admitted in the aforesaid central duct (9), the neck being fitted with a cap (25) for storage purposes. Linking means (L) are provided between the neck (24) and the cap (25). The packaging comprises between the neck ()24) and the central duct (25) connecting elements (J) differing from the aforesaid linking elements (L), with a part (28) on the neck (24) and on the central duct (9) an associated part (29) arranged so as not to interfere with the part (26) of the aforesaid linking means (L) located on the neck (24).

10 Claims, 3 Drawing Sheets

TWO BOTTLE PACKAGING ALLOWING SEPARATE STORAGE AND MIXING FOR USE OF TWO PRODUCTS, PARTICULARLY LIQUIDS

FIELD OF THE INVENTION

The invention relates to packaging with two bottles allowing separate storage and mixing for use with two products, particularly liquids, the packaging being of the type comprising:

- a first bottle to contain the first product, open at the base in the form of a skirt and with a distributor-like fitting at the top;
- an intermediate component secured to the base of the first bottle comprising a central duct to receive at the top a separable plug allowing closure of the first bottle;
- a second bottle to contain the second product, with a neck engaging in the said central duct, the said neck having a cap for storage, connecting means particularly of the threaded type, being provided between the neck and the cap, the assembly being such that when the cap is removed from the second bottle, its neck is able to displace the plug to allow mixing of the two products

BACKGROUND OF THE INVENTION

U.S. Pat. No. A 4 823 946 shows packaging of this type in which two plastic material bottles are envisaged. In the storage position the second bottle is closed by a cap screwed on to its neck. When using and mixing the contents of the two bottles, the cap on the second bottle is unscrewed and the second bottle is placed in the central duct of the intermediate component with a thread able to associate with the thread on the neck of the second bottle receiving the screw cap.

In dual packaging of this type, it is practically imperative for its acceptance by customers, that the insertion of the second bottle into the intermediate component to eject the plug, be carried out by rotation with a limited number of turns and preferably less than one turn.

Since according to U.S. Pat. No. A 4 823 946 the thread on the neck of the second bottle serves both to receive the screw cap during storage, and to associate with the intermediate component, the thread must be of a relatively large pitch so that in use, extensive axial displacement of the neck related to the intermediate component is obtained with a small angle of rotation.

The need for a large pitch thread on the neck of the second bottle effectively imposes the use of plastic material for the second bottle, since with a glass bottle it is practically impossible to produce a thread with a large pitch simultaneously giving a satisfactory seal, owing to the particular manufacturing conditions for such glass bottles.

The two bottle packaging defined above is used for products, some of which keep unsatisfactorily in a plastic material bottle.

This is the case particularly when packaging on the one hand a color solution intended for hair-tinting, and on the other hand, the oxydizer required when using the coloring solution; in order to color the hair with "oxydizing colors", it is necessary to ensure development of the color on the hair by the addition of an oxydizer such as hydrogen peroxide, on the color at the time of its use on the hair. The dual bottle presentation is consequently important owing to the extent of the market for hair coloring materials.

The color solution generally placed in the second bottle, stores poorly inside a polyethylene or polypropylene plastic material bottle, since the oxygen passes through the wall and oxydizes the color before application to the hair.

SUMMARY OF THE INVENTION

The purpose of the invention is more particularly to provide packaging of the type outlined above in which the design is such that the second bottle is intended particularly to contain an oxydizing color—for hair tinting, of material other than plastic material, more particularly glass, without opposition on the part of the structure of this packaging to the choice of such a material.

The invention is also intended as packaging of the type in question which remains easy and as economical as possible to manufacture, allowing storage under good conditions, in limited space and easily and quickly used.

According to the invention a two bottle packaging allowing separate storage and mixing when used for two products particularly two liquids, of the type defined above, is characterised by the fact that between the neck of the second bottle and the central duct there are connecting means differing from the aforesaid connecting means, and comprising a part provided on the neck of the second bottle and an associated part in the central duct arranged so as not to interfere with the part of the said connecting means provided on the neck of the second bottle.

The connecting means preferably comprise on the neck of the second bottle, at least one radially outward projecting lug and for the intermediate component central duct, one helical ramp at least to cooperate with the lug. Two diametrically opposed lugs are generally provided, matching two diametrically opposing helical ramps.

Since according to the invention the connecting means differ completely from the linkage means, the same constraints imposed on the connecting means for easy use (in relation to the intermediate component a large extensive axial displacement of the second bottle with a small angle of rotation), do not apply to the linking means.

Linking means between the cap and the neck of the second bottle may therefore consist of a thread more particularly of reduced pitch, whereas—the helical ramp provided on the central duct may be of larger pitch than that of the thread, the pitch of the helical ramp being such that axial displacement of the neck of the second bottle related to the intermediate component, required to remove the plug, is obtained in less than one turn.

Production of the lug(s) on a glass bottle presents no particular problem. The second bottle can thus be made of glass, providing an effective barrier protecting the contents from atmospheric oxygen.

The association of a helical ramp located on the intermediate component, and of a lug provided on the neck of the second bottle, ensures accurate location at the end of the movement of the second bottle related to the intermediate component. Under these conditions, the first and second bottles may be of oval cross section since strict positioning at the end of the movement ensured by the helical ramp/lug system allows a good superimposition of the large diameters of the oval sections of both bottles and consequently a satisfactory presentation.

The intermediate component will preferably have in its central duct, a cap safety lock operating in conjunction with the lug on the second bottle, the lock consisting of the lug passing the projection at the end of the screwing movement in the helical ramp.

In storage, the single or multiple lugs on the neck of the second bottle locate on a cylindrical section, of external diameter essentially the same as the external diameter of the cap closing the second bottle, whereas the internal diameter of the intermediate component central duct suffices to allow access for the said cylindrical section and therefore the cap.

In storage the neck of the second bottle complete with plug can be introduced into the intermediate component central duct, to reduce the space required. The packaging can be arranged so that in storage the cap on the second bottle fully enters the intermediate component central duct.

In storage the packaging is preferably of the one piece type, the second bottle with its neck inserted into the intermediate component, being connected to the upper bottle or the intermediate component, particularly by means of a tamperproof band.

The intermediate component may have a skirt with a lower part engaging the second bottle on completion of connection, with eventual notch securing, forming a cap safety lock, operative after use.

The intermediate component may comprise a hollow part in the form of an annual dish or recess admitting the skirt located at the base of the first bottle, the seal between intermediate component and skirt being achieved against the inner face of the skirt.

The skirt on the first bottle may comprise an outer bead at least locking with a shoulder on the inner face of the outer wall of the annular dish of the intermediate component. Several shoulders with angular separation extending along part of the circumference, may be provided on the intermediate component, which includes a window beneath each shoulder to facilitate molding and removal.

Apart from the above provisions, the invention includes a number of other provisions referred to more explicitly by way of typical example described with reference to the appended non-restrictive drawings.

BRIEF DESCRIPTION OF THE DRAWINGS

As in FIG. 4.

Finally, as in FIG. 4.

DETAILED DESCRIPTION OF THE INVENTION

Figure 1:
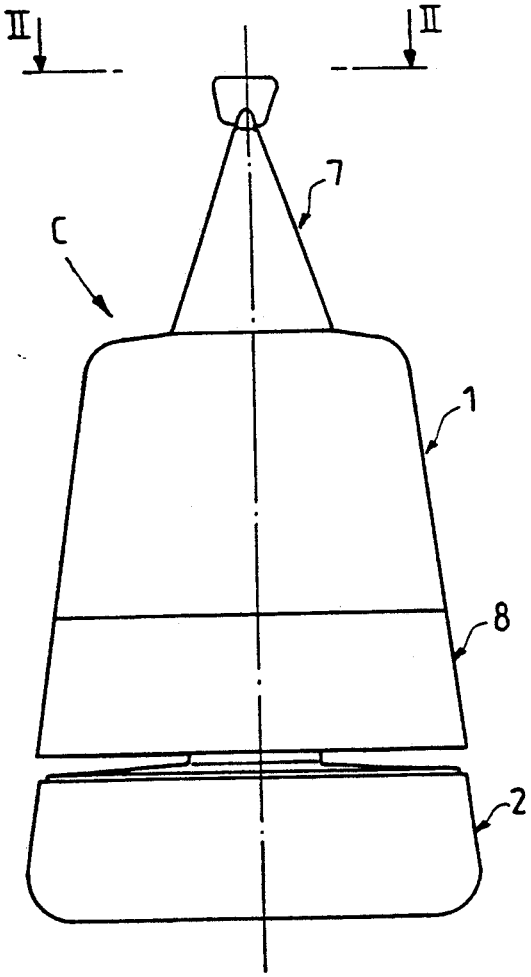
FIG. 1 in the drawings is a front view of the dual bottle packaging, the second bottle being engaged into the intermediate component.
Figure 2:
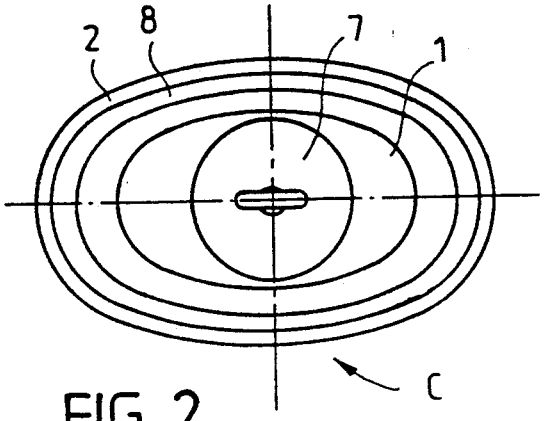
FIG. 2 is a plan view related to FIG. 1.
Figure 3:
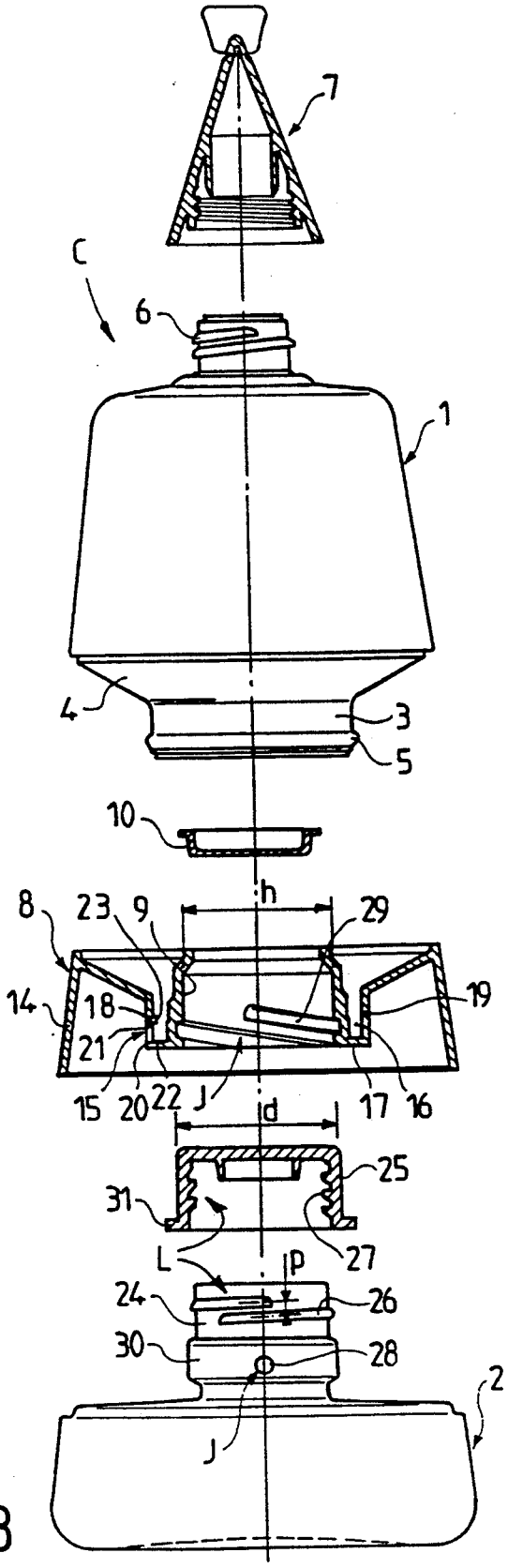
FIG. 3 is an exploded view of FIG. 1 packaging.

Referring to the drawings, particularly FIGS. 1 to 3, these show the packaging C with two bottles 1, 2 allowing separate storage and mixing for use of two products, generally liquid products.

The first bottle 1 contains a first liquid product, for instance an oxydizer used to mix with an oxydising color contained in the second bottle 2 for the purpose of hair coloring.

Bottle 1 is open at the base with a circular section cylindrical skirt 3 of relatively small diameter. The skirt 3 is connected by an outwards taper 4 with the wall of the main part of bottle 1. Close to the lower edge the skirt 3 has a circular radially projecting lip 5 on its outer face. At the top, located at the extreme opposing end from the skirt 3, the bottle 1 has a threaded duct 6 on which a closed distributor cap can be screwed to form a seal, its end being easily snapped off to create an opening to pour the product when used..

An intermediate component 8 forming a type of collar is secured to the base 3 of bottle 1. This plastic material component 8 has a central duct 9 of mainly circular section cylindrical form, admitting a plug 10 at the top, being a type of cap inserted as a seal on the upper end of the duct 9. The thrust on the plug 10 towards bottle 1 separates it from duct 9, and allows it to enter the bottle 1. As in FIG. 4, duct 9 enters the skirt 3 forming a seal with the inner face of the skirt 3. This seal is achieved at—the level of a peripheral projecting bead 11 on the outer surface of the duct 9, coming into contact with the inner surface of the skirt 3. The cylindrical lower part 12 of the skirt 3 may also come to bear and form a seal on an area 13 of the outer surface of the duct 9 located towards the base of the duct.

Intermediate component 8 has an external wall 14 of similarly shaped cross-section to that of bottle 1. This shape is preferably oval, as shown in FIG. 2.

The connection between duct 9 and the outer wall 14 of component 8 is ensured by a hollow part 15, in the form of an annular dish or recess 16 with the concave part turned towards bottle 1; the end wall 17 of the dish connects with the end of duct 9 opposing bottle 1. The recess 16 is able to admit the skirt 3 of bottle 1, establishing a mechanical link.

This mechanical link can be ensured as shown in the example in the drawing, by means of shoulders 18 radially projecting towards the inside of the recess 16, on the inner surface of the outer wall 19 of this recess. The shoulders 18 only extend over a fraction of the circumference and are separated from each other by regular angular equi-spacing. As an example three shoulders 18 can be provided, their centers being at angular distances of 120°.

The intermediate component 8 has at right angles to each shoulder 18, a window 20 extending partly into the lower area of wall 19, and partly into the outer area of wall 17. This window 20 is limited at the top by a radial edge 21 located beneath the shoulder 18 and at the bottom by an edge 22 within the wall 17. This arrangement allows the intermediate component 8 to be molded in a two-part mold, one part moving upwards and the other downwards. In the radial direction the edge 22 may be slightly inside the lower edge 23 of the lip 18.

The continuous peripheral edge 5 of skirt 3 is designed to clip beneath the shoulders 18.

When component 8 complete with plug 10 (see FIG. 4) is assembled on skirt 3 of bottle 1, the bottle is closed and sealed in the lower part.

It is clear that other means ensuring mechanical linkage and achieving the seal between skirt 3 and component 8 are possible. The peripheral bead 11 could be eliminated providing that the quality of the seal at the level of component 12 is satisfactory.

The central duct 9 of component 8 is designed to receive at the bottom the neck 24 of the second bottle 2 containing the color.

The neck 24 is fitted with a cap 25 ensuring a seal for storage purposes.

Linkage means L are provided between the neck 24 and the cap 25. These consist of a thread 26 on the outer cylindrical surface of neck 24 and an associated thread 27 on the inner cylindrical surface of the cap 25, arranged in the form of a cylindrical hood. The pitch p of thread 26 (and consequently thread 27) is of limited value.

Figure 4:
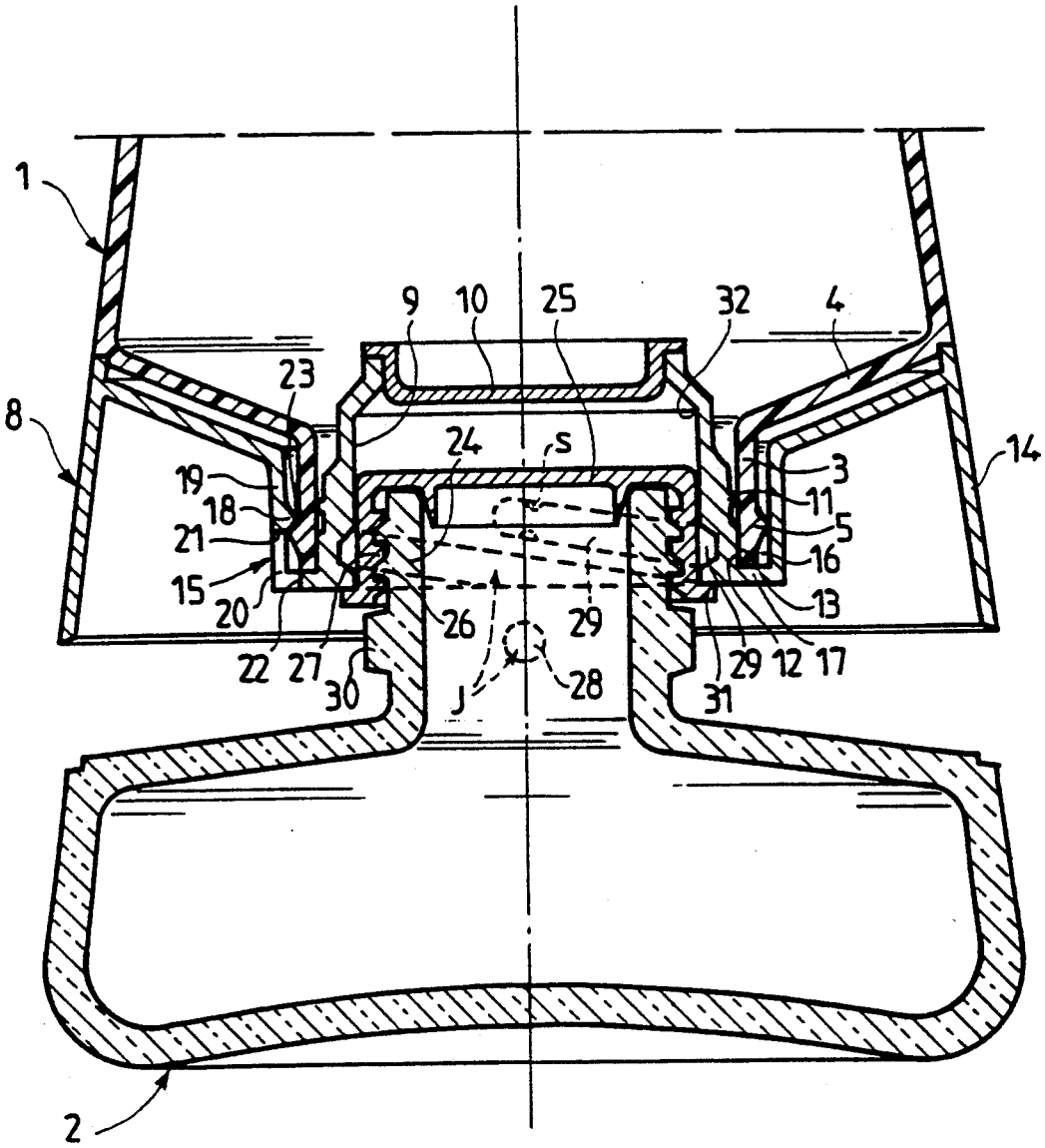
FIG. 4 is a larger scale section of the lower part of the first bottle, the intermediate component and upper part of the second bottle in storage.

The external diameter d of cap 25 is preferably slightly smaller than the internal diameter h of the lower part of duct 9 so that the cap 25 can enter the duct as shown in FIG. 4.

Connecting means J differing from the linkage means L are provided between the central duct 9 and the neck 24. These connecting means J comprise a part located on neck 24, consisting of two diametrically opposed projections 28. It is clear that the number of projections 28 may be greater or smaller than two. The connecting means J also include an associated part of lugs 28, provided in the central duct 9 and formed by two helical ramps 29 respectively associating with the lugs 28.

The pitch of the ramps 29 is distinctly greater than the pitch p of the thread 26.

The pitch of the helical ramps 29 is preferably selected so that related to component 8, axial movement of the neck 24, required to eliminate the plug 10 is obtained with a rotation smaller than one turn of the neck 24 compared with component 8.

The inner cylindrical surface of duct 9 has a diameter h greater than the maximum outer diameter of thread 26 so that helical ramps 29 cannot interfere with the thread 26 when the neck 24, released from its cap 25 is introduced into the duct 9.

The lugs 28 are located on a cylindrical section radially projecting from the neck, and of external diameter essentially equal to the external diameter d of cap 25.

This cylindrical section 30 can enter the central duct 9.

The second bottle 2 is preferably made of glass so as to give the color contained in the bottle maximum protection against atmospheric oxygen.

Production of the glass bottle 2 presents no problem; the thread 26 on the glass bottle, has a reduced pitch allowing a satisfactory fit with cap 25, which would otherwise not be satisfactory with a larger pitch such as for ramps 29. Production of the lugs 28 on a glass bottle also presents no problems.

The combination of lugs 28 and helical ramps 29 allows accurate angular positioning of the bottle 2 in relation to component 8, on completion of assembly of the lugs 28 and ramps 29. Under these conditions an oval cross section may be given to bottle 1, outer wall 14 of component 8 and bottle 2, shown in FIG. 2, since accurate positioning of the various assemblies allows satisfactory super-imposition of the large dimensions of the transverse section's of bottle 1, component 8 and bottle 2.

The intermediate component 8 may include a safety screw lock consisting of a projection s at the upper end of each helical ramp 29. This projection s is intended to be crossed by the relevant lug 28 on completion of screwing, this being ensured by elastic distortion. When the lug 28 has crossed the projection (see FIG. 5), the lug is locked preventing unscrewing of the bottle 2 from component 8.

The outer wall 14 of component 8 forms a skirt of which the lower part covers the second bottle 2 on completion of connection. Locking means signalled by a slight click at the end of the rotation of bottle 2 and removal of the plug 10 can be provided between the lower part of the skirt 14 and the bottle 2, also forming an additional safety lock against unscrewing.

In the example illustrated in the drawings, particularly FIG. 4, the cap 25 has a collar 31 in the lower part radially projecting outwards and limiting the entry of the cap 25 into the duct 9, in the storage position.

It would be possible to provide an arrangement of the cap 25 and neck 24 such that when the bottle 2 is closed by cap 25 for storage, the cap is introduced further forward into the duct 9, for instance up to the level of the bend 32 marking the start of a reducing taper in the upper part of the duct 9, being the part receiving the plug. In this way in storage the cap 25 would be flush with the plug 10 and the overall space required by the packaging would be minimal.

This being so, the filling, storage and use of the bottles are effected in the following manner.

The plug 10 is positioned at the upper end of the duct 9. The skirt 3 of bottle 1 is then latched into position in the annular recess 16 of component 8. The lower part of bottle 1 is thus closed and sealed. The duct 6 in this bottle 1 is not yet fitted with its distributor end. The bottle 1 is then filled, for instance with the oxydising liquid product, should the the packaging be intended for an oxydising color. The bottle 1 is then closed with the distribution end 7 with an uncut end.

The glass bottle 2 is filled with its liquid contents, for instance the color in the example considered here, then closed and sealed with cap 25 which is screwed on to neck 24.

This being so bottles 1 and 2 can be stored separately. For storage purposes the cap 25 fitted on the neck 24 is introduced into the lower part of duct 9 as shown in FIG. 4.

When a user wishes to use the packaging to mix the two liquids, the bottle 2 is removed from the intermediate component 8 and cap 25 is unscrewed.

The user inserts the neck 24 free of its cap, into duct 9 and axially pushes the neck while turning it until the lugs 28 come into contact with the base of the helical ramps 29.

Figure 5:
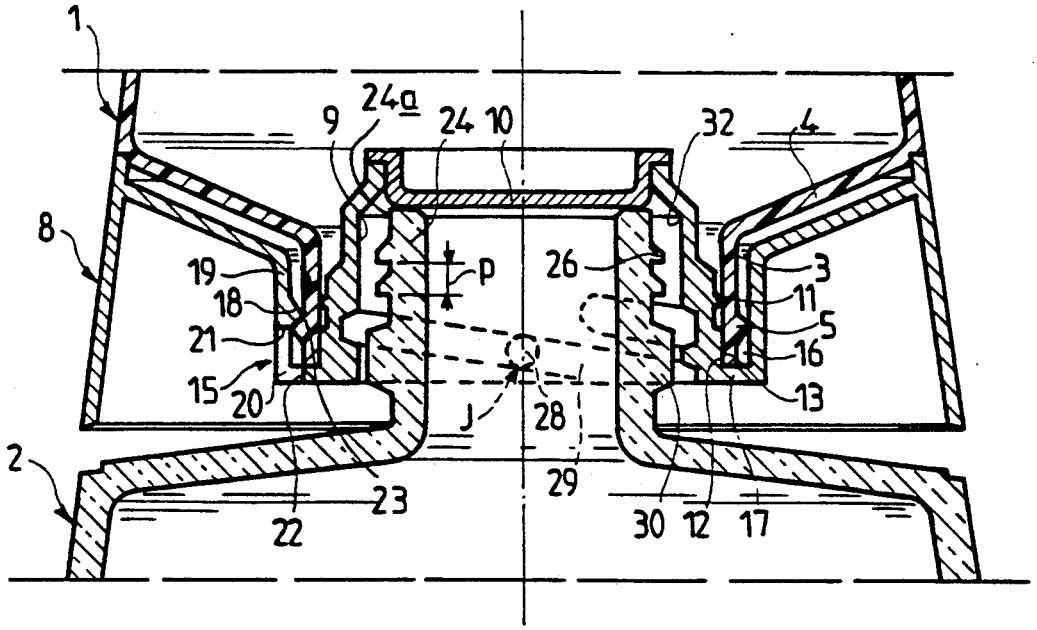
FIG. 5 shows the packaging with the cap removed from the neck of the second bottle and the lugs on the neck start engaging in the helical ramps of the intermediate component.

With a rotary movement between bottle 2 and component 8, the user ensures that the lugs 28 rise in ramps 29 as shown in FIG. 5.

Figure 6:
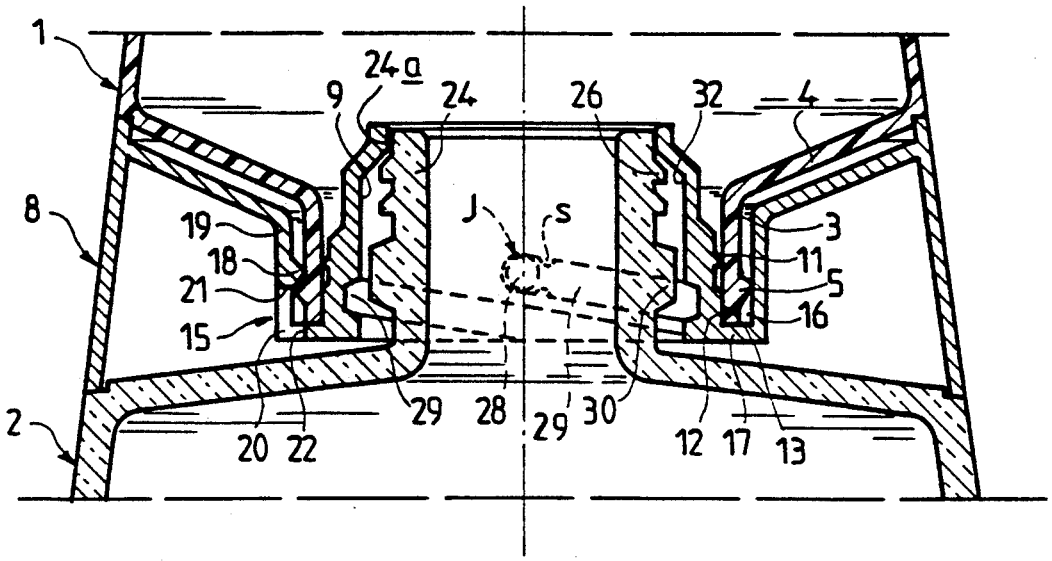
FIG. 6 shows completion of the assembly of the second bottle and intermediate component for mixing purposes, the plug having been removed from the intermediate component.

On completion of the upwards movement, the upper part of neck 24 eliminates the plug 10 and thus opens bottle 1. In the meantime the cylindrical upper edge 24*a* of neck 24 comes to bear as a seal against the inner surface of the upper end of duct 9 as shown in FIG. 6.

The lugs 28 are stopped at the end of their screwing movement by means of the safety screw locks s in ramps 29.

After shaking the bottle assembly to ensure good mixing of the two liquids, the user can then open the distribution end 7 to pour out the mixture.

The bottle 2 remains secured and sealed to bottle 1 during the application of the product.

The packaging according to the invention is thus a simple and quick means of use, allowing the use of a glass bottle 2, i.e. a material effectively protecting the color against oxydizing during storage.

We claim:

1. A package for containing two separate liquids to be stored separately from each other and to be mixed at the time of use, said package comprising a first bottle for containing a first product, said first bottle having a base having an opening therein in the form of a skirt and having an upper end opposite said base provided with a distributor opening and a cap;

an intermediate component attachable to said base of said first bottle, said intermediate component including a central duct having at one end a removable plug insertable into said opening in said base of said first bottle for closing said first bottle;

a second bottle for containing a second product, said second bottle including a neck dimensioned to be insertable into said central duct of said intermediate component, said neck of said second bottle being fitted with a removable cap for closure thereof and threaded linking means located on said neck on the exterior thereof, said neck of said second bottle and said central duct of said intermediate component having connecting means, said connecting means including at least two lugs located on said neck of said second bottle on diametrically opposite sides thereof, said lugs each projecting radially outwardly of said neck, said central duct of said intermediate component including at least one helical ramp for cooperation with one of said lugs of said second bottle, said central duct including a second helical ramp diametrically located with respect to said first helical ramp and for cooperation with the other of said two lugs, said neck of said second bottle having a threaded portion spaced from said lugs and having a selected pitch, said helical ramps of said intermediate portion having a larger pitch than that of said threaded portion of said neck of said second bottle, said second bottle being made of glass.

2. The package as claimed in claim 1, wherein said first and second bottles have oval cross-sections.

3. The package as claimed in claim 1, wherein said neck of said second bottle includes a cylindrical portion and said lugs are each located on said cylindrical portion which is provided with an external diameter substantially equal to the external diameter of a cap for said second bottle, said central duct having an internal diameter such that said central duct will receive said cylindrical portion and a cap placed on said second cylindrical portion of said second bottle.

4. The package as claimed in claim 1, wherein said intermediate component has an external wall having a lower edge for engaging said second bottle on completion of connection of said second bottle to said intermediate component and means being provided for locking said intermediate component to said second bottle upon completion of insertion of said neck of said second bottle into said central duct.

5. The package as claimed in claim 1, wherein said intermediate component is provided with a hollow portion in the form of an annular recess for receiving a skirt, said first bottle having a skirt depending from said base thereof, said skirt and said hollow part being dimensioned so that said skirt sealingly engages in said hollow part.

6. The package as claimed in claim 5, wherein said skirt comprises an outer bead and said central duct includes a shoulder portion for cooperation with said outer bead of said first bottle for retaining said intermediate portion on said base of said first bottle.

7. The package as claimed in claim 6, wherein said shoulder extends over a portion of the circumference of said central duct and said intermediate component includes a window adjacent said shoulder.

8. The package as in claim 1, wherein the pitch of the helical ramp (29) is such that with relation to the intermediate component (8) the axial displacement of the neck (24) to engage the plug (10) is obtained in less than one turn.

9. Packaging as claim 1, characterised in that the intermediate component (8) comprises in the central duct (9), at least one cap block cooperating with the lug on the second bottle.

10. The package as in claim 9, characterised in that the cap lock comprises a projection cleared by the lug (28) on completion of screwing into place and located in the helical ramp (29).

* * * * *